United States Patent [19]

Forsythe et al.

[11] Patent Number: 5,040,636

[45] Date of Patent: Aug. 20, 1991

[54] MERCHANDISE CHECKOUT WORK STATION

[75] Inventors: Donald L. Forsythe, Norcross, Ga.; Mark S. Hoffman, Dover, Ohio

[73] Assignee: NCR Corporation, Dayton, Ohio

[21] Appl. No.: 437,552

[22] Filed: Nov. 16, 1989

[51] Int. Cl.[5] ..... A47F 9/04

[52] U.S. Cl. ..... 186/61; 186/66

[58] Field of Search ..... 186/59-69; 312/140.1; 235/383, 462

[56] References Cited

U.S. PATENT DOCUMENTS

| | | | |
|---|---|---|---|
| 2,286,548 | 6/1942 | Jackson et al. | 312/140.1 |
| 2,776,730 | 1/1957 | Crawford . | |
| 2,884,094 | 4/1959 | Roy . | |
| 3,715,862 | 2/1973 | Schohl | 53/390 |
| 3,960,420 | 6/1976 | Speraw et al. | 312/140.1 |
| 3,990,540 | 11/1976 | Aleshire et al. . | |
| 4,043,426 | 8/1977 | Verkler . | |
| 4,138,000 | 2/1979 | Hartup . | |
| 4,618,032 | 10/1986 | Woolf | 186/61 |
| 4,775,782 | 10/1988 | Mergenthaler et al. | 235/146 |
| 4,779,706 | 10/1988 | Mergenthaler | 186/61 |
| 4,838,383 | 6/1989 | Saito et al. | 186/61 X |
| 4,909,356 | 3/1990 | Rimondi et al. | 186/61 |

FOREIGN PATENT DOCUMENTS

| | | | |
|---|---|---|---|
| 2616642 | 12/1988 | France | 186/63 |
| 59-208671 | 11/1984 | Japan | 235/383 |

*Primary Examiner*—F. J. Bartuska

*Attorney, Agent, or Firm*—Wilbert Hawk, Jr.; Albert L. Sessler, Jr.

[57] ABSTRACT

A merchandise checkout work station is of generally L-shaped configuration as viewed from above, and includes a merchandise holding area, a work area for a scanner and a keyboard, a bagging area, an elevated writing surface, a purchase set-aside area and a support area for holding a printer and a card embosser, all arranged to be conveniently accessible to a checkout operator. Security panels are provided to define a working area for the operator.

1 Claim, 5 Drawing Sheets

MERCHANDISE CHECKOUT WORK STATION

BACKGROUND OF THE INVENTION

This invention relates to merchandise checkout work stations, and more particularly relates to merchandise checkout work stations designed to improve customer service and increase transaction processing efficiency.

In present-day checkout systems, which are widely employed in retail establishments such as supermarkets and discount stores, a point-of-sale terminal is customarily positioned adjacent to a checkout counter which includes an optical scanning system for scanning a coded label on a merchandise item, and for generating signals representing data associated with the merchandise item. The price of the merchandise item is then displayed in a display visible to the customer and the checkout operator, which may be part of the point-of-sale terminal, or which may be a separate unit located elsewhere. The purchased merchandise items are customarily placed in bags and the customer pays the checkout operator for the merchandise items purchased. Since retail establishments such as supermarkets and discount stores often handle a high volume of customers, particularly at peak hours, and since floor area is normally intensively used in such establishments, it is important that each individual work station be designed to be as compact and efficient in operation as possible.

SUMMARY OF THE INVENTION

The work station of the present invention is designed to queue the customer being serviced through a lane next to the work station in such a manner as to allow the next customer to place merchandise to be checked out on a holding surface of the work station while the checkout transaction for the preceding customer is being completed, and is also designed to provide a compact, efficient and readily accessible arrangement for everything required by a checkout operator to perform a checkout operation.

In accordance with one embodiment of the invention, a merchandise checkout work station having a generally L-shaped configuration as viewed from above, comprises: a vertical wall surface disposed along the long outer side of the L shape for defining the path of customer movement past the work station; a flat horizontal counter holding area adjacent to the end of the long portion of the L shape on which merchandise articles of a customer waiting to check out may be placed; a work area adjacent to the holding area on the long side of the L shape; a scanner in the work area to enable data to be sensed from merchandise being checked out; a keyboard in the work area to enable data relating to merchandise transactions to be manually entered by a checkout operator; a bagging area located next to the work area at the other side thereof from the holding area and including at least one bagging receptacle therein to accommodate a bag to be filled with purchased merchandise which has been checked out; a raised surface adjacent to the bagging area at the other side thereof from the work area to facilitate the writing of checks by a customer checking out; a support area adjacent to said raised surface, comprising the short side of the L shape for accommodating business equipment such as a printer required in a checkout operation, whereby the L-shaped configuration provides a work station shaped so that all of the necessary equipment for performing checkout operations is conveniently located within easy reach of the operator and at least one panel extending from one end of the L shape and defining the space to the inside of the L shape for accommodating the operator of the work station.

It is accordingly an object of the present invention to provide a compact and efficient merchandise checkout work station.

Another object is to provide a work station in which all equipment required by the operator for checkout operations is located in a convenient and readily accessible arrangement.

With these and other objects, which will become apparent from the following description, in view, the invention includes certain novel features and combinations of parts, preferred forms or embodiments of which are hereinafter described with reference to the drawings which accompany and form a part of this specification.

DESCRIPTION OF THE PREFERRED EMBODIMENTS

Figure 1:
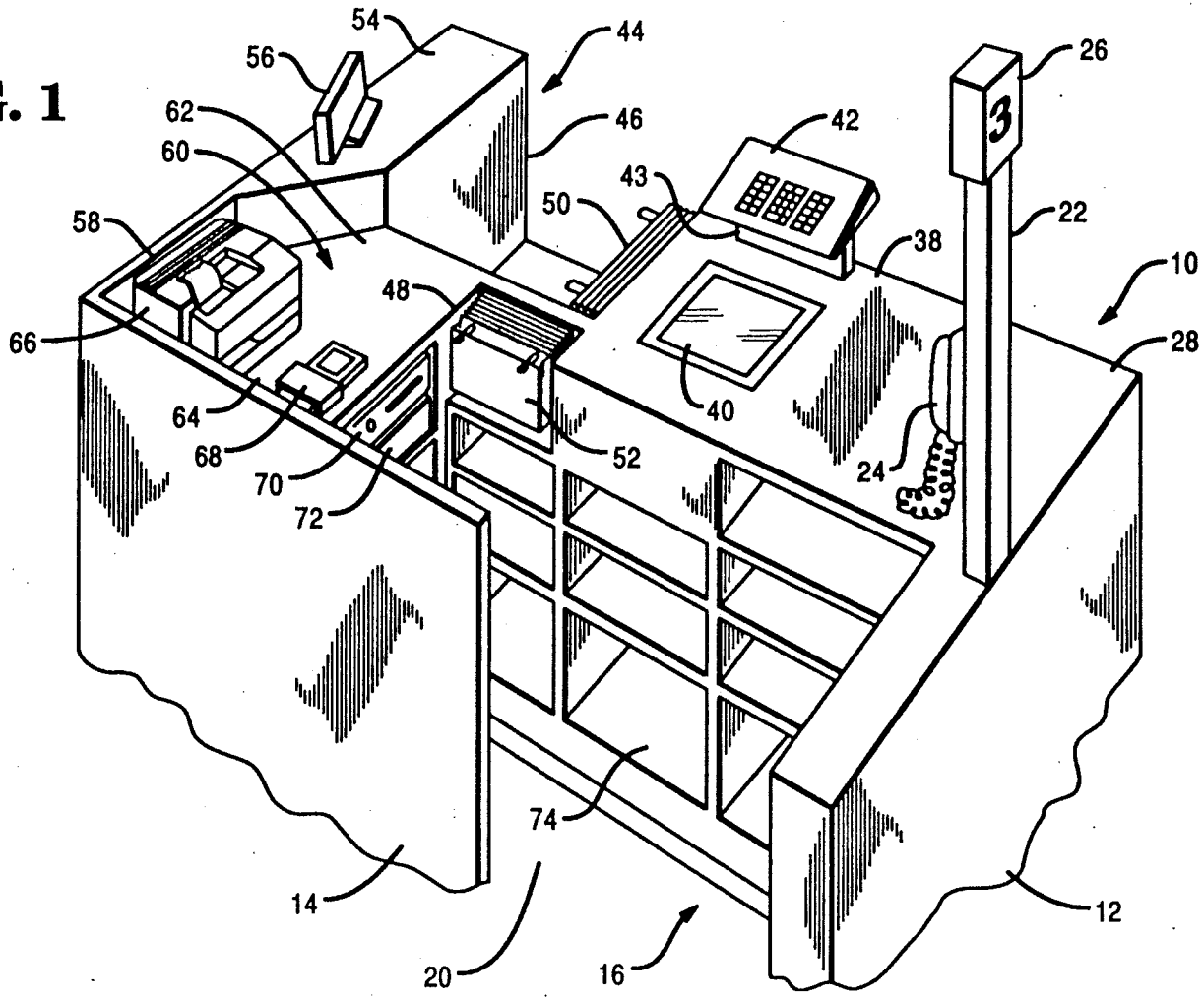
FIG. 1 is a perspective view of one embodiment of the merchandise checkout work station employing a scanner mounted flush with a work surface of said work station.
Figure 4:
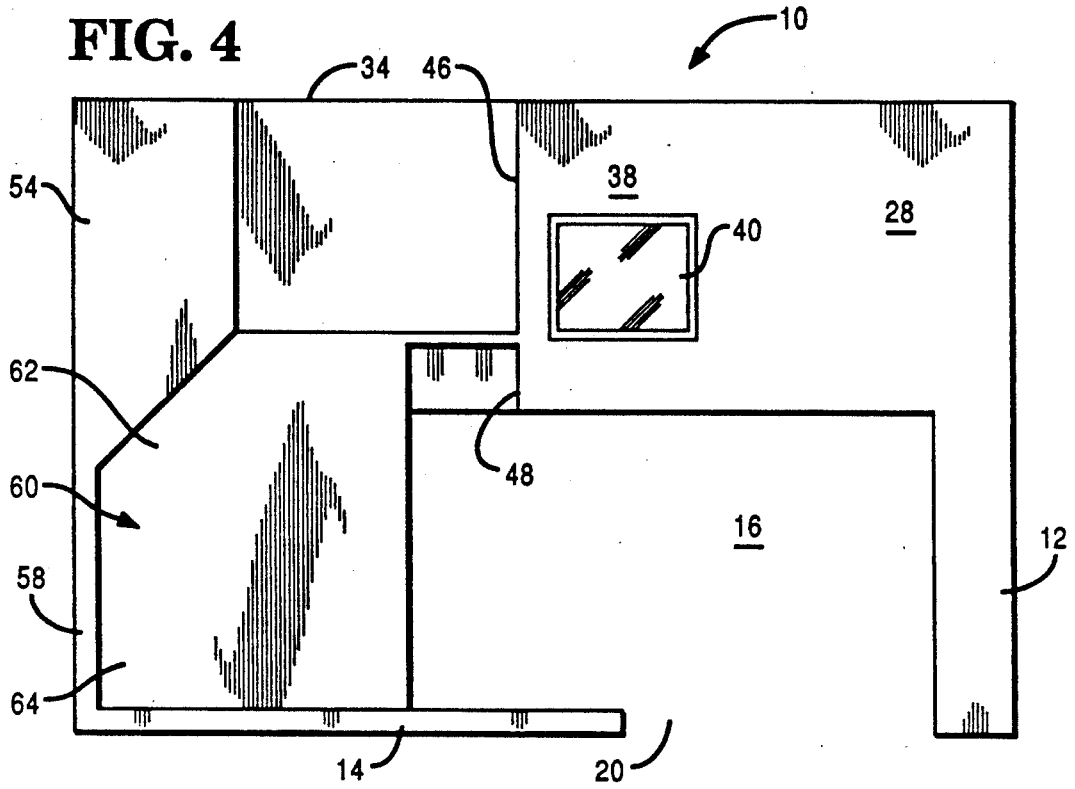
FIG. 4 is a plan view of the work station per se.
Figure 5:
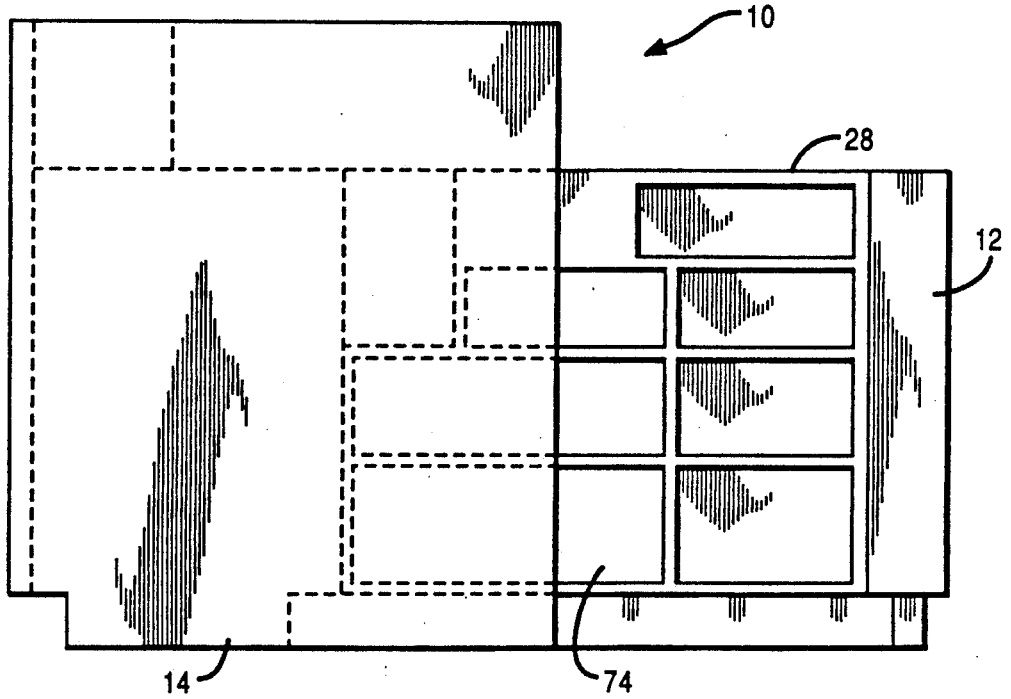
FIG. 5 is an elevation view of the work station shown in FIG. 4.
Figure 6:
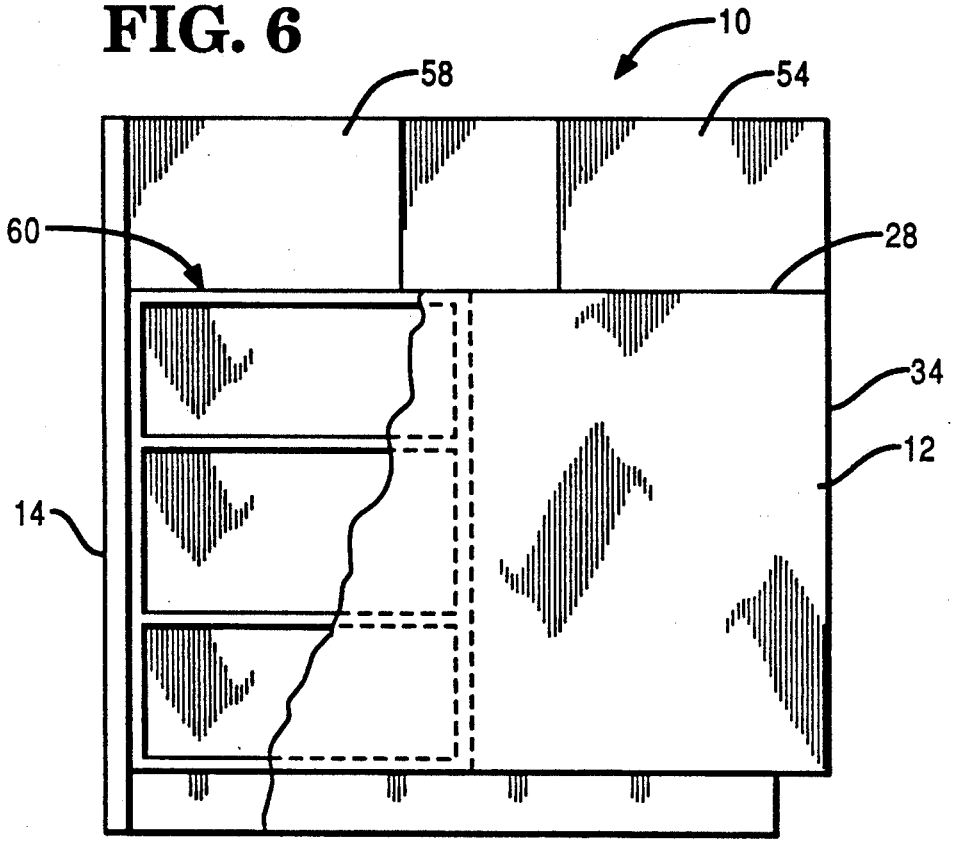
FIG. 6 is an end view, partially broken away, of the work station of FIG. 4.

Referring now to FIG. 1, there is shown a merchandise checkout work station 10. The work station itself may be considered to be of generally L-shaped configuration when viewed from above, as may also be seen in the plan views of FIGS. 3 and 4. The work station 10 also includes two security panels 12 and 14 which define a space 16 occupied by a checkout operator 18. The security panel 12 extends at a right angle from the end of the long side of the L shape. The security panel 14 extends at a right angle from the short side of the L shape. The ends of the panels 12 and 14 are spaced apart to provide an opening 20 of a size which permits the operator 18 to enter and leave the space 16. As may best be seen in FIGS. 1 and 5, the two panels are of different heights, each height corresponding to the height of a portion of the work station adjacent to the panel.

At the end of the long side of the L shape is located an aisle identification post 22 having a telephone 24 secured thereto. The post has at its top a sign 26 bearing the aisle number.

Adjacent to the post 22 is a flat horizontal counter area 28 which may be used by a customer 30 (FIG. 3) as a holding area to deposit articles from a grocery cart 32 to await checking out. A vertical wall 34 disposed along the long side of the L shape of the work station 10 defines a path along which the customer 30 moves during the checkout process, as indicated by the arrow 36, showing the direction of customer flow. The customer 30 may deposit articles to be purchased on the counter area 28 while the operator 18 is completing a transaction involving a previous customer, thus saving time and leaving the articles conveniently located for the operator to process in the next transaction.

Figure 3:
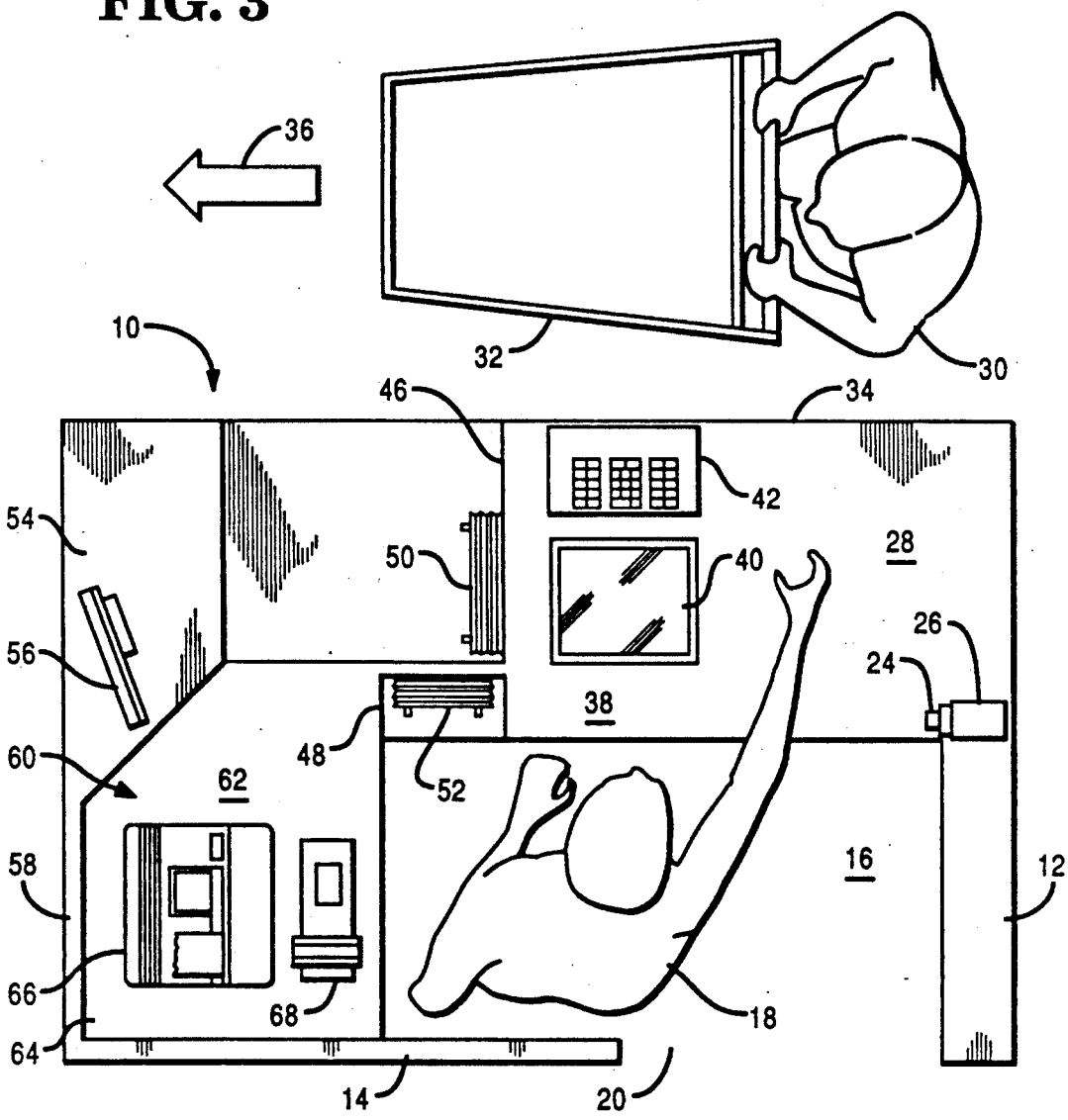
FIG. 3 is a plan view of the work station of FIG. 1, showing the manner in which a customer and an operator use the work station.

Immediately to the left of, and contiguous with, the counter area 28 is a continuation of the counter comprising a work area 38 having a scanner 40 and a keyboard 42 associated therewith, as shown in FIGS. 1 and 3. The scanner 40 is mounted horizontally and flush with the surface of the work area 38 and is used to scan symbols, such as bar codes, on the merchandise items being checked out, in a well-known manner. The keyboard 42 is used to enter price information for merchandise items which cannot be scanned, and to provide means for entering commands to the point-of-sale system incorporated in the work station 10. For convenience in use, the keyboard 42 may be slidably mounted on a base 43 to enable it to be moved closer to the operator 18 when desired.

The two contiguous areas 28 and 38 are coplanar and are located at a height from the floor which is convenient for the deposit of merchandise items on area 28, and the scanning of items and operation of the keyboard 42 on area 38. Such a height may be approximately three feet.

To the left of the work area 38 is a bagging area 44, which includes two bagging receptacles 46 and 48. The bagging receptacle 46 is of a large size to accommodate standard sized grocery bags 50, and has an open side in the wall 34 to facilitate movement of a loaded bag from the receptacle 46 to be grasped by a customer 30, or to be placed in a grocery cart 32 for transportation outside the retail establishment. The bagging receptacle 48 is of a relatively smaller size to accommodate smaller individual merchandise items in smaller sized bags 52. The receptacle 48 has an open side in the inside surface of the work station 10 to facilitate removal of a filled bag 52 by the operator 18.

To the left of the bagging area 44 as viewed in FIGS. 1 and 3, and located adjacent to the base of the L shape of the work station 10, is a raised surface 54, which may be used by a customer 30 for such purposes as writing a check to pay for the articles purchased, once the checkout procedure has been completed. The surface 54 is at a higher elevation than the contiguous surfaces 28 and 38, in order to provide a height which is convenient for the customer 30 in writing a check, sorting grocery coupons, or performing other activities incidental to a checkout operation. A suitable height for the surface 54 is approximately four feet from the floor. A display 56 is mounted on the surface 54 to provide the customer 30, and the operator 18, if desired, with data concerning the checkout transaction, such as the price of each individual item, the credit for any merchandise coupons, and the total amount due.

A short wall 58 extends from the raised surface 54 to the security panel 14 at a height equal to that of the surface 54 and the security panel 14. Located to the inside of the wall 58 and on the short side of the L shape of the work station 10 is a surface 60 which is the same height from the floor as the areas 28 and 38. This area 60 includes a purchase set-aside area 62 on which may be placed articles which the customer decides not to purchase, and also includes a support area 64 on which are placed elements of the checkout system, such as a printer 66 and a credit card embosser 68. Located on shelves below the surface 64 are a cash drawer 70 and a data processor 72 which is connected to the scanner 40, the keyboard 42, the display 56, the printer 58 and the cash drawer 70, to control and coordinate the functioning of these devices.

The work station 10 also contains a number of additional shelves, designated generally by the reference character 74. These shelves may be used for any appropriate purpose, such as the placement of any additional components of the point-of-sale processing system, the storage of supplies such as record media for the printer 66 and the credit card embosser 68, the storage of personal belongings of the operator 18, or the temporary storage of items brought to the work station 10 by a customer 30 but for some reason not purchased.

Figure 2:
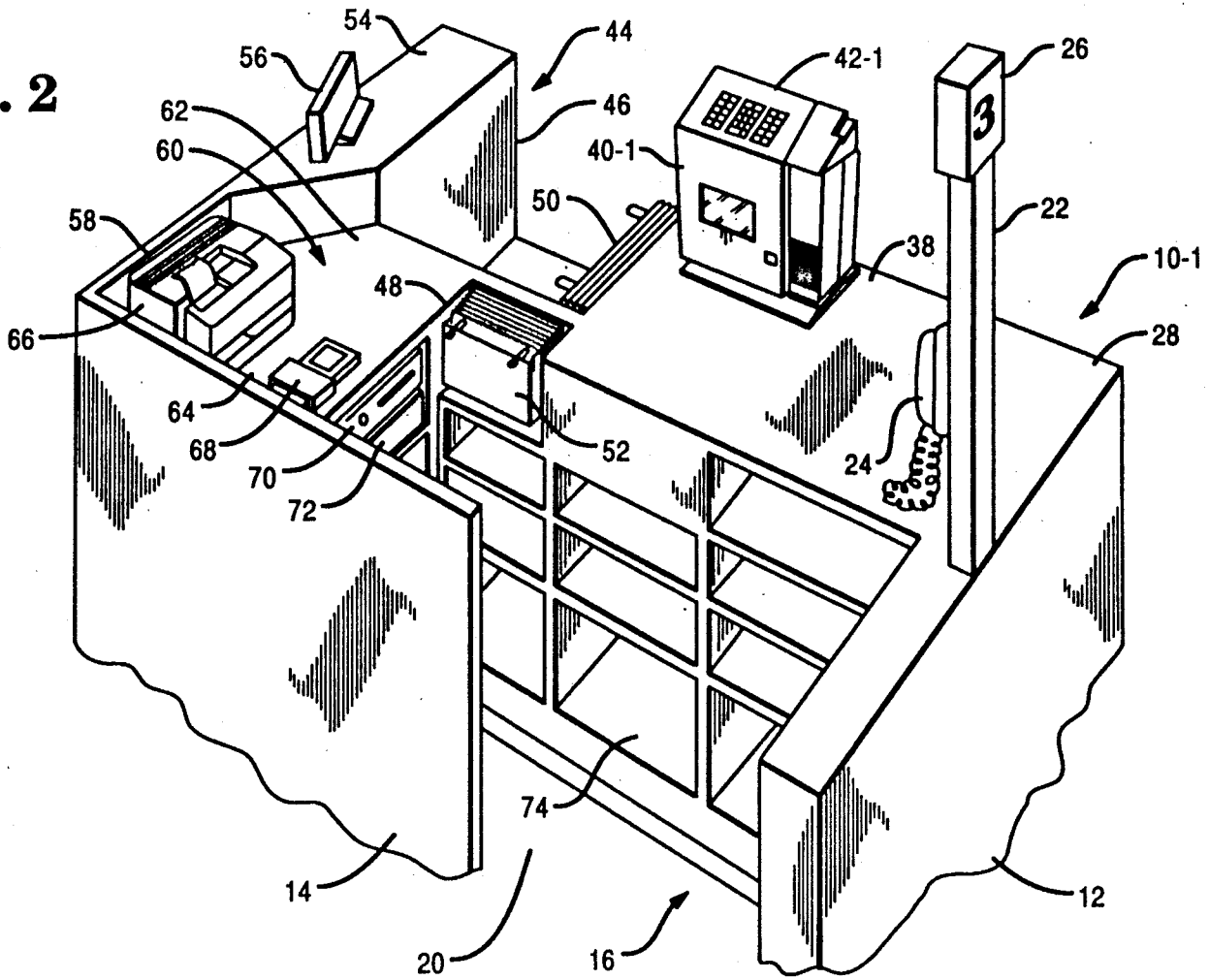
FIG. 2 is a perspective view of another embodiment of the merchandise work station which employs a scanner vertically mounted on a work surface of said work station, with a keyboard mounted atop the scanner.

Shown in FIG. 2 is a second embodiment of the work station of the present invention, designated as 10-1 in FIG. 2. Parts of the work station 10-1 which are unchanged from the embodiment of FIGS. 1 and 3 bear the same reference characters as in FIGS. 1 and 3. The only elements which have been modified in FIG. 2 are the scanner 40-1 and the keyboard 42-1. In the embodiment of FIG. 2, the horizontal scanner 40 which is mounted horizontally and flush with the surface of the work area 38 has been replaced with a vertically mounted scanner 40-1. Such a scanner may be used advantageously with certain types of merchandise. In addition, the keyboard 42-1 has been mounted at the top of the scanner 40-1. If desired, the keyboard 42-1 may be slidably mounted on the scanner 40-1, so that it can be moved toward the operator 30 for greater ease of operation. It will be seen that a work station could readily be designed to utilize alternatively either a vertically mounted scanner or a horizontally mounted scanner interchangeably, as shown in the copending patent application, NCR Docket No. 4441, which is assigned to the assignee of the present application.

When the work station 10 (or 10-1) is being used, the operator 18 is stationed in the space 16, with all of the parts of the work station 10 which are normally used in a checkout transaction being readily accessible, due to the manner in which the work station is configured. A customer 30 approaches the work station 10 from the right, as viewed in FIG. 3, takes the merchandise items to be purchased out of the shopping cart 32 and places them on the holding area 28. The operator 18 grasps each item, passes it over the scanner 40, and places it in a bag 50 or 52 in one of the receptacles 46 or 48. If the price or other information relating to a particular item cannot be obtained by use of the scanner 40, it can be manually entered into the point-of-sale system by the operator using the keyboard 42. The keyboard 42 is also employed to cause the system to generate totals and other desired information. A printed record of the transaction is provided by the printer 66, which is conveniently located immediately to the left of the operator 18. If the transaction is being paid for by check, the customer 30 may use the raised surface 54 as a writing surface to prepare the check. If a credit card is to be used in payment for the transaction, the card embosser 68, which also is located immediately to the left of the operator 18, may be used. During the time that the current transaction is being completed, a new customer 30 may be placing the merchandise items to be purchased on the holding area 28, so that the next transaction may be commenced as soon as the current one is completed.

While the forms of the invention shown and described herein are admirably adapted to fulfill the objects primarily stated, it is to be understood that it is not intended to confine the invention to the forms or embodiments disclosed herein, for it is susceptible of embodiment in various other forms within the scope of the appended claims.

What is claimed is:

1. A merchandise checkout work station having a generally L-shaped configuration comprising a long portion and a short portion at right angles thereto as viewed from above, the long portion of said L-shaped configuration having a long outer side and a shorter inner side, comprising:

a vertical wall surface disposed along the long outer side of the L shape for defining the path of customer movement past the work station;

a flat horizontal counter holding area adjacent to the end of the long portion of the L shape on which merchandise articles of a customer waiting to check out may be placed;

a work area to the front of the normal working position of a checkout operator adjacent to the holding area on the long side of the L shape;

a scanner in the work area to enable data to be sensed from merchandise being checked out;

a keyboard in the work area to enable data relating to merchandise transactions to be manually entered by a checkout operator;

a bagging area located next to the work area at the other side thereof from the holding area and including a large bagging receptacle for grocery bags and a small bagging receptacle for bags for small items, said large bagging receptacle being positioned adjacent to the vertical wall surface and the small bagging receptacle being positioned adjacent to the inner side of the L shape, both bagging receptacles being open at one side to facilitate bag removal and having a common central dividing wall therebetween;

a raised surface adjacent to the bagging area at the other side thereof from the work area to facilitate the writing of checks by a customer checking out;

a support area adjacent to the raised surface, comprising the short portion of the L shape, for accommodating business equipment such as a printer required in a checkout operation, whereby the L shaped configuration provides a work station shaped so that all of the necessary equipment for performing checkout operations is conveniently located within easy reach of the operator; and at least one panel comprising a security panel extending from one end of the L shape and defining the space to the inside of the L shape for accommodating the operator of the work station.

* * * * *